US009474681B2

(12) United States Patent
Sedic

(10) Patent No.: US 9,474,681 B2
(45) Date of Patent: Oct. 25, 2016

(54) WEARABLE MASSAGER FOR COUPLES

(71) Applicant: LELO, Inc., San Jose, CA (US)

(72) Inventor: Filip Sedic, Shanghai (CN)

(73) Assignee: LELO, Inc., San Jose, CA (US)

( * ) Notice: Subject to any disclaimer, the term of this patent is extended or adjusted under 35 U.S.C. 154(b) by 18 days.

(21) Appl. No.: 14/184,689

(22) Filed: Feb. 19, 2014

(65) Prior Publication Data

US 2015/0231024 A1 Aug. 20, 2015

(30) Foreign Application Priority Data

Dec. 9, 2013 (CN) ..... 2013 2 0801348 U

(51) Int. Cl.
*A61H 19/00* (2006.01)
*A61H 23/02* (2006.01)

(52) U.S. Cl.
CPC ..... *A61H 19/50* (2013.01); *A61H 19/34* (2013.01); *A61H 19/44* (2013.01); *A61H 23/0263* (2013.01); *A61H 2201/1671* (2013.01); *A61H 2201/1676* (2013.01); *A61H 2201/5035* (2013.01); *A61H 2201/5084* (2013.01); *A61H 2201/5097* (2013.01)

(58) Field of Classification Search
CPC ..... A61F 5/41; A61F 2005/414; A61F 2005/417
USPC ..... 600/38–41
See application file for complete search history.

(56) References Cited

U.S. PATENT DOCUMENTS 1,636,159 A 7/1927 Unne
3,554,184 A 1/1971 Habib
3,626,931 A 12/1971 Bysakh
3,978,851 A * 9/1976 Sobel ..... 601/95
3,996,930 A 12/1976 Sekulich (Continued)

FOREIGN PATENT DOCUMENTS

CA 2 491 249 A1 6/2006
EP 1 477 149 A1 11/2004

(Continued)

OTHER PUBLICATIONS

Acrylic Xtc Pleasure Curve, Swedish Erotica, Discreet-Romance.com, two pages, [online] [retrieved Dec. 26, 2012], Retrieved from the internet <http://www.discreet-romance.com/acrylic-pleasure-curve-clear-adult-sex-toys-21708.html>.

(Continued)

*Primary Examiner* — Samuel Gilbert
(74) *Attorney, Agent, or Firm* — Fenwick & West LLP

(57) ABSTRACT

A remote-controllable wearable massager for couples including a first arm, a second arm, and a connecting member coupling the first arm to the second arm provides massaging motion for a user and can be used by the user during sexual intercourse with a partner. During operation, the first arm of the massager is inserted into the user's vagina and the second arm rests on the region near the user's clitoris. The connecting member is configurable such that the user can flexibly adjust the distance between the first arm and the second arm of the massager to allow for insertion of the first arm into a vagina, and rigid enough to forcibly compress the first arm towards the second arm, allowing the massager to be worn as a clip. During operation, the distal end of the first arm rotates about the intersection between the first arm and the connecting member.

18 Claims, 3 Drawing Sheets

(56) References Cited

U.S. PATENT DOCUMENTS

| | | | | |
|---|---|---|---|---|
| D273,132 | S | 3/1984 | Moloff | |
| 4,574,791 | A | 3/1986 | Mitchener | |
| 5,460,597 | A | 10/1995 | Hopper | |
| 5,690,603 | A | 11/1997 | Kain | |
| 5,713,833 | A | 2/1998 | Milligan | |
| 5,797,950 | A | 8/1998 | Takashima | |
| 5,853,362 | A | 12/1998 | Jacobs | |
| 5,871,533 | A | 2/1999 | Boutos | |
| 6,053,881 | A | 4/2000 | Boodramsingh et al. | |
| 6,132,366 | A | 10/2000 | Ritchie et al. | |
| 6,179,775 | B1 | 1/2001 | Thompson | |
| 6,183,426 | B1 | 2/2001 | Akisada et al. | |
| 6,190,307 | B1 | 2/2001 | Tsai | |
| 6,368,268 | B1 | 4/2002 | Sandvick et al. | |
| 6,592,516 | B2 | 7/2003 | Lee | |
| 6,685,660 | B1 | 2/2004 | Taverna et al. | |
| 6,741,895 | B1 | 5/2004 | Gafni et al. | |
| 7,001,317 | B2 | 2/2006 | Marcotte | |
| 7,081,087 | B2 | 7/2006 | Jannuzzi | |
| 7,104,950 | B2 | 9/2006 | Levy | |
| 7,166,072 | B2 | 1/2007 | Smith | |
| 7,347,815 | B2 | 3/2008 | Serbanescu | |
| 7,383,728 | B2 | 6/2008 | Noble et al. | |
| 7,438,681 | B2 | 10/2008 | Kobashikawa et al. | |
| 7,577,476 | B2 | 8/2009 | Hochman et al. | |
| D605,779 | S | 12/2009 | Murison | |
| 7,658,676 | B2 | 2/2010 | Ohta | |
| 7,762,945 | B2 | 7/2010 | Blumenthal | |
| 7,815,582 | B2 | 10/2010 | Imboden et al. | |
| 7,931,605 | B2 | 4/2011 | Murlson | |
| 7,938,789 | B2 | 5/2011 | Imboden et al. | |
| 8,012,082 | B1 | 9/2011 | Lefew | |
| 2002/0103415 | A1 | 8/2002 | Manska et al. | |
| 2002/0188233 | A1 | 12/2002 | Denyes | |
| 2003/0023139 | A1 | 1/2003 | Hartz | |
| 2003/0097041 | A1 | 5/2003 | Ritchie et al. | |
| 2004/0186344 | A1 | 9/2004 | Januzzi | |
| 2004/0230093 | A1 | 11/2004 | Marshall | |
| 2005/0203335 | A1 | 9/2005 | Stachon | |
| 2005/0273024 | A1 | 12/2005 | Nan | |
| 2008/0009775 | A1 * | 1/2008 | Murison | 601/46 |
| 2010/0174137 | A1 | 7/2010 | Shim | |
| 2011/0071445 | A1 | 3/2011 | Imboden et al. | |
| 2013/0331745 | A1 | 12/2013 | Sedic | |

FOREIGN PATENT DOCUMENTS

| | | | |
|---|---|---|---|
| GB | 2 375 714 | B | 12/2004 |
| JP | 2004-313690 | A | 11/2004 |
| JP | 2005-288079 | A | 10/2005 |
| WO | WO 02/38100 | A2 | 5/2002 |
| WO | WO 03/089071 | A2 | 10/2003 |
| WO | WO 2006/063461 | A1 | 6/2006 |

OTHER PUBLICATIONS

AdultSensations.com, "Reflective Gel Smooth Double Dong," California Exotic Novelties,two pages, [online] [retrieved Dec. 26, 2012], Retrieved from the internet <http://www.adultsensations.com/california-exotic-reflective-smooth-double-dong-p-80.html>

Atlantic Innovations, LLC, "Double Ended Self-Pleasurizer, Too Timid," four pages, [online] [retrieved Dec. 27, 2012], Retrieved from the internet <http://www.tootimid.com/double-ended-self-pleasurizer.htmlf>.

Berman Center Adonis GSpot/Clitoral Stimulator, Berman Center, Amazon.com, two pages, [online] [retrieved Dec. 26, 2012], Retrieved from the internet <http://www.amazon.com/Berman-Center-Adonis-Clitoral-Stimulator/dp/B000C9OAY6>.

California Exotic Novelties, Impulse, Waterproof Wireless Bunny, and Elite 7X—7 Function Sea Lion, Apr. 4, 2004, one page, [online] [retrieved from the internet May 17, 2012], Retrieved from the internet <web.archive.org/web/20040404062456/http:/calexotics.com/main.htm>.

California Exotic Novelties, Self Pleasurizer, Impulse™, Stargazer™ and Clit Kisser, Apr. 4, 2004, one page, [online] [retrieved from the internet May 17, 2012], Retrieved from the internet <web.archive.org/web/20040404062456/http:/calexotics.com/main.htm>.

Double Pleaser Jelly, Adam and Eve Toys, Newhaba.com, two pages, [online] [retrieved Jan. 11, 2013], Retrieved from the internet <http://www.newhaba.com/adamandevetoys/7525.htm>.

Dual Penetrator™ Vibrator, California Exotic Novelties, CalExotics.com, two pages, [online] [retrieved Dec. 26, 2012], Retrieved from the internet <http://www.calexotics.com/p-22479-dual-penetrator-vibrator.aspx>.

Dual Rocker, California Exotic Novelties, EdenFantasys.com, two pages, [online] [retrieved Dec. 26, 2012], Retrieved from the internet <http://www.edenfantasys.com/dual-rocker/adult-toys-dvds-15152>.

Dual Vibrating Flexi-Dong™, California Exotic Novelties, CalExotics.com, two pages, [online] [retrieved Dec. 26, 2012], Retrieved from the internet <http://www.calexotics.com/p-22326-dual-vibrating-flexi-dong.aspx>.

Elite 7X 7 Function Massager With Silicone Sleeve, Swedish Erotica, Spicetoy.com, three pages, [online] [retrieved Dec. 26, 2012], Retrieved from the internet <http://www.spicetoy.com/elite-7x-7-function-massager-with-silicone-sleeve.html>.

Elite 7X 7 Function Sea Lion, Swedish Erotica, Ourtoys.com, one page, [online] [retrieved Dec. 26, 2012], Retrieved from the internet <http://ourtoys.com/0575-12-3.htm>.

Evolved Novelties, "Evolved Novelties Bendable You Too, Purple" Amazon.com, Inc., 1996-2012, four pages, [Online] [Retrieved on Aug. 13, 2012], Retrieved from the Internet<URL:http://www.amazon.com/Evolved-Novelties-Bendable-You-Purple/dp/B004FV9WWC>.

Feeldoe Slim Vibrator, Tantusinc.com, one page, [online] [retrieved Dec. 26, 2012], Retrieved from the internet <http://tantusinc.com/catalog/Specialty-Items/Feeldoe-Slim>.

Femme Fatale G-Spot Teaser Pleaser, Nasstoys of New York, Nasstoys.com, two pages, [online] [retrieved Dec. 26, 2012], Retrieved from the internet <http://www.nasstoys.com/products/details.cfm?ProductID=2020-1>.

Fujiko's Asian Odyssey with Dual Pronged Stimulator, California Exotic Novelties, VitaSprings.com, two pages, [online] [retrieved Jan. 11, 2013], Retrieved from the internet <http://www.vitasprings.com/fujiko-asian-odyssey-california-exotic-novelties.html>.

Gemini Probe, Nasstoys of New York, Nasstoys.com, one page, [online] [retrieved Dec. 26, 2012], Retrieved from the internet <http://www.nasstoys.com/products/details.cfm?ProductID=1764>.

Google Books, The Many Joys of Sex Toy: The Ultimate How-to Handbook for Couples and Singles, Ann Semans, one page, [online] [retrieved May 10, 2013], Retrieved from the internet <http://books.google.com/books?id=nyUVuPs5GiUC&pg=PA53&dq=sex+toys+guide&source=gbs_toc_r&cad=4#v=snippet&q=ultime&f=false>.

Hitachi Magic Wand and Deluxe G Spot Attachment Combo, Hitachi, Amazon.com, two pages, [online] [retrieved Dec. 26, 2012], Retrieved from the internet <http://www.amazon.com/Hitachi-Magic-Deluxe- Attachment-Combo/dp/B000RY6SHS>.

Hot Entertainment, Inc., Hot Adult Toys A Researcher HET-298, Title 2, Chapter 6, Femipet, May 2, 2004, two pages.

In the Matter of Certain Kinesiotherapy Devices and Components Thereof, U.S. International Trade Commission, Investigation No. 337-TA-823, Commission Opinion, Jul. 12, 2013, 43 pages.

Jack Rabbit Vibrator, TheRabbitVibrator.com, 3 pages, [online] [retrieved Dec. 26, 2012], Retrieved from the internet <http://www.therabbitvibrator.com/original-jack-rabbit-vibrator.aspx>.

Land.aslia.net, Femipet, dated 2004, 28 pages, [online] [retrieved from the internet Mar. 23, 2013], Retrieved from the internet <http://land.aslia.net/h-tools/experience/experience2004.htm>.

MoonBonBon, Femme Fatale G-Spot Teaser Pleaser Pink, two pages, [online] [retrieved from the internet May 17, 2012], Retrieved from the internet <http://www.moonbonbon.com/in-ja-femme-fatale-gspot-teaser-pleaserbubblegum-p-6017.html>.

(56) References Cited

OTHER PUBLICATIONS

MyLoveMachine.com, Adonis G Spot and Clitoral Stimulator, listing product release date of Aug. 22, 2005, two pages, [online] [retrieved from the internet May 17, 2012], Retrieved from the internet <http://www.mylovemachine.com/sex-toys/SE975014-adonis-g-spot-and-clitoral-stimulator.html>.
MyLoveMachine.com, Gemini Probe Pink, listing product release date of Jan. 1, 2000, two pages, [Online] [retrieved from the internet May 17, 2012], Retrieved from the internet <http://www.mylovemachine.com/sex-toys/NW1764-Gemini-probe-pink.html>.
Natural Contours, Natural Contours Ultime Vibrator, 2012, two pages, [Online] [Retrieved Dec. 21, 2012], Retrieved from the Internet<URL:http://natural-contours.com/IBS/SimpleCat/Product/asp/product-id/36716941.html>.
Natural Contours, From Women for Women, Jun. 1, 2002, two pages, [online] [retrieved May 9, 2013], Retrieved from the internet <http://webarchive.org/web/20020601144600/http://www.natural-countours.com/candida.html>.
Natural Contours, Jolie, Superbe, Petite, Ultime and Magnifique Brochure, two pages, 2002.
Natural Contours, Petite, Magnifique, Ultime and Superbe, May 16, 2001, one page, [online] [retrieved May 9, 2013], Retrieved from the internet <http://webarchive.org/web/20010516031310/http://www.natural-countours.com/>.
Natural Contours, Petite, Superbe and Magnifique Brochure, one page, 2002.
Natural Contours, Petite, Superbe and Magnifique Brochure, one page, 2001.
Nine Parts Desire, Snuggle Puss Product Detail Page, Nine Parts Desire, 2006, one page, [Online] [Retrieved on Jan. 7, 2010] Retrieved from the Internet<URL:http://www.ninepartsdesire.com/index.php?main.sub.--page=product.sub.--in-fo&products.sub.--id=306 (last visited Jan. 7, 2010).
Onamagra Femipet, "A Sensual Vibrator Compatible with All Types of Women," Jan. 12, 2004, nine pages, [online] [retrieved from the internet Mar. 23, 2013], Retrieved from the internet <http://webarchive.org/web/20040112135317/http:/daimaoh.kir.jp/ro/femipet.htm>.
PCT International Search Report and Written Opinion, PCT Application No. PCT/US2012/043167, Oct. 5, 2012, nine pages.
Purr Inc., "Snuggle Puss," 2007, one page. [Online] [Retrieved on Jun. 11, 2009] Retrieved from the Internet <URL:http://www.mypurr.com/servlet/the-157/vibrators,-women,-pleasure,-vibration,/Detail>.
Reflective Gel™—AC/DC Double Dong 18", California Exotic Novelties, CalExotics.com, two pages, [online] [retrieved Dec. 26, 2012], Retrieved from the internet <http://www.calexotics.com/p-22143-reflective-gel-acdc-double-dong-18.aspx>.
Rock-Chick G-Spot Vibrator, Rocks-Chick.com, one page, [online] [retrieved Dec. 26, 2012], Retrieved from the internet <http://www.rock-chick.com/productlist.php?product=RCPKV>.
Sensual Universe, Dual Vibrating Flexi-Dong, listing product release date Mar. 26, 2003, one page, [online] [retrieved from the internet May 17, 2012], Retrieved from the internet <www.cduniverse.com/productinfo.asp?pid=6650398&style=atoy>.
SensualAdviser.com, Feeldoe Slim Blue, listing product release year 2005, two pages, [online] [retrieved from the internet May 17, 2012], Retrieved from the internet <http://www.sensualadviser.com/-/info_sex_toy/noveltyid=TAN9812.html/-FBFFEC58/2EF8-4D62-982B-D0947260FBCC?section=387&tab=1>.
SexToy.com, Clitoral Dancer, Sep. 5, 2004, one page, [online] [retrieved from the internet May 9, 2013], Retrieved from the internet <http://web.archive.org/web/20040905173322/http://www.sextoy.com/clitoralstimulatingvibrators/SE0678-04.html>.
SexToy.com, Crystalessence Dual Penetrator Vibrator, including reviews from 2004-2012, three pages, [online] [retrieved from the internet May 17, 2012], Retrieved from the internet <http://www.sextoy.com/Crystalessence-Dual-Penetrator-Vibrator/sku.-SE0834-12>.
Silicone Ultra™ Lighted Dolphin™, California Exotic Novelties, www.SensualAdviser.com, one page, [online] [retrieved Dec. 26, 2012], Retrieved from the internet <http://www.sensualadviser.com/-/info_sex_toy/noveltyid=CE0570-14.html>.
*Standard Innovation Corp.*, v. *Leloi Ab et al.*, In the United States District Court, Southern District of Texas, Houston Division, Civil Action No. 4:11-cv-04172, Original Complaint for Patent Infringement, filed Dec. 2, 2011, nine pages.
The Pincher Ribbed G-spot Dildo, Trinity Vibes, Amazon.com, three pages, [online] [retrieved Dec. 26, 2012], Retrieved from the internet <http://www.amazon.com/The-Pincher-Ribbed-G-spot-Dildo/dp/B0071B1PJ6>.
The Velvet Kiss Collection Little Dragon, Nasswalk of New York, Amazon.com, three pages, [online] [retrieved Dec. 26, 2012], Retrieved from the internet <http://www.amazon.com/Velvet-Collection-Little-Dragon-Lavender/dp/B004KI70I8>.
Toy4pleasure, Tawney's Yellow G Spot Tickler™, copyright 2004, three pages, [online] [retrieved May 17, 2012], Retrieved from the internet <http://www.toy4pleasure.com/detail.aspx?fid=0&cid=0&pid=3460>.
Treasures for Pleasure, U Send Me, copyright 2005, two pages, [online] [retrieved from the internet May 17, 2012], Retrieved from the internet <http://www.treasuresforpleasure.com/Merchant2/merchant.mvc?Screen=PROD&Store_Code=TFP&Product_Code=GT626BL&Category_Code>.
U Send Me, Golden Triangle, FindAVibe.com, two pages, [online] [retrieved Dec. 26, 2012], Retrieved from the internet <http://www.findavibe.com/Anal-Sex-Toys/Anal-Vibrators/U-send-me.aspx>.
Valhouli, Christina, "The Naked Truth," The International Design Magazine, one page, Apr. 2001.
Vivid G-Spot Tickler—Savanna, DocJohnson.com, one page, [online] [retrieved Dec. 26, 2012], Retrieved from the internet <http://www.docjohnson.com/vivid-g-spot-tickler-purple.html>.
Water Missile Tear Drop Probe, California Exotic Novelties, QueensofPassion.com, two pages, [online] [retrieved Dec. 26, 2012], Retrieved from the internet <http://www.queens-of-passion.com/product/Water_Missile_Tear_Drop_Probe__-_Blue/0/SE0019122>.
Web Merchants, Inc., "Snugglepuss—G-spot Vibrator," Last Updated Jan. 20, 2012, three pages, [Online] [Retrieved on Jan. 30, 2012] Retrieved from the Internet <URL:http://www.edenfantasys.com/vibrators/g-spot-vibrators/snugglepuss>.
Wikipedia, Hitachi Magic Wand, states product market date 1970s, two pages, [online] [retrieved from the internet May 17, 2012], Retrieved from the internet <http://en.wikipedia.org/wiki/Hitachi_Magic_Wand>.
Wikipedia, Rabbit Vibrator, states product market date 1990s, two pages, [online] [retrieved from the internet May 17, 2012], Retrieved from the internet <http://en.wikipedia.org/wiki/Rabbit_vibrator>.
State Intellectual Property Office of the People's Republic of China, Second Office Action, Chinese Patent Application No. 2012800431162, Aug. 14, 2015, seven pages.

* cited by examiner

WEARABLE MASSAGER FOR COUPLES

BACKGROUND

The present invention relates generally to personal massagers, and more particularly to remote-controllable wearable massagers for couples.

Personal massaging devices have been developed in a variety of shapes and sizes to provide stimulation and/or massage nearly every part of the human body. Personal massagers can perform in a number of manners. Conventional massagers, such as hand-held massagers, are usually configured for use by one operator for the operator, and can be configured for vaginal penetration and stimulation. Such massagers generally do not allow for multiple vaginal penetration during sexual activity, limiting their use during sexual activity with a partner.

SUMMARY

Embodiments include a remote-controllable wearable massager for couples including a first arm, a second arm, and a connecting member. The first arm and the second arm are coupled via the connecting member, which is coupled to the proximal ends of the first and second arms. The structure of the massager allows for the first arm of the massager to be inserted into a user's vagina and for the second arm to be in contact with or near the user's clitoris during use. The interior of the first arm can include one or more motors and/or off-center weights or axles, causing the first arm to gyrate in a massaging motion during an operating mode of the massager. The second arm includes a button and a power connector interface. The button can be an on/off switch and can also activate wireless pairing with a remote controller. In addition, the second arm can include an indicator, one or more motors configured to cause the second arm to vibrate during the operating mode, or any combination thereof. In one embodiment, the indicator indicates a power level of the massager and, in another embodiment, the indicator indicates a massage mode of the massager. In one embodiment, the massage mode of the massager can be indicated by the remote controller and, in another embodiment, the massager mode of the massager can be indicated by the button on the second arm. The connecting member can be a spring or a deformable material such that a user can increase, decrease, or adjustably fix the distance between the first arm and the second arm of the massager during use.

During operation, the distal end of the first arm of the massager rotates about the intersection of the proximal end of the first arm and the connecting member. The wearable massager for couples can be made of silicone or another suitable elastic, soft, and durable material, allowing for the rotation of the first arm about the connection between the first arm and the connecting member.

The figures depict various embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION

Wearable Massager for Couples

Figure 1A:
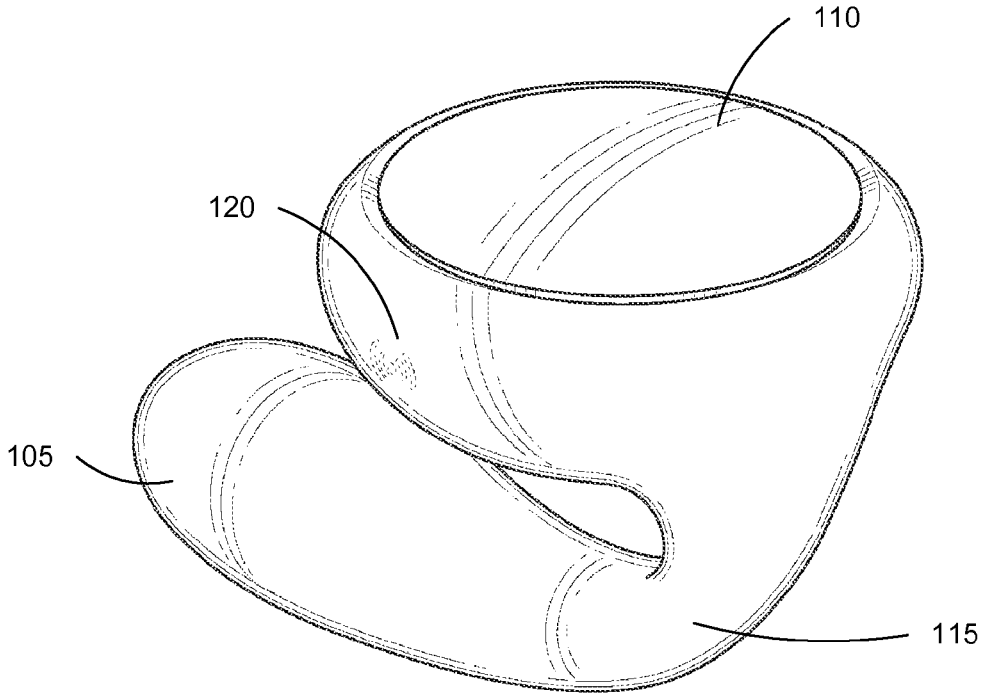
FIGS. 1A, 1B, 1C, and 1D collectively illustrate an example of a wearable massager for couples, according to one embodiment.
Figure 1B:
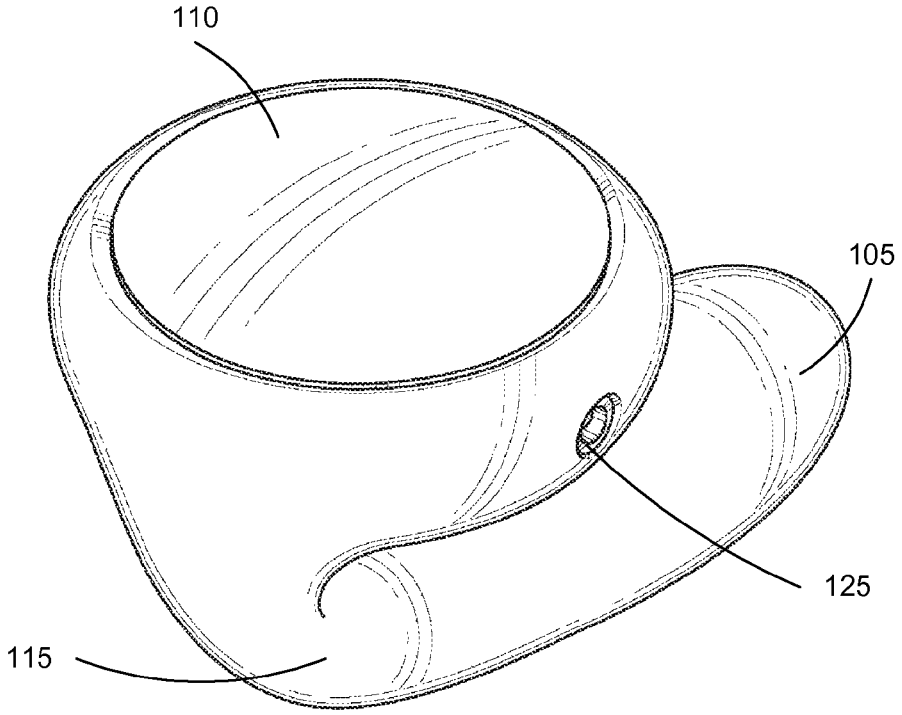
Figure 1C:
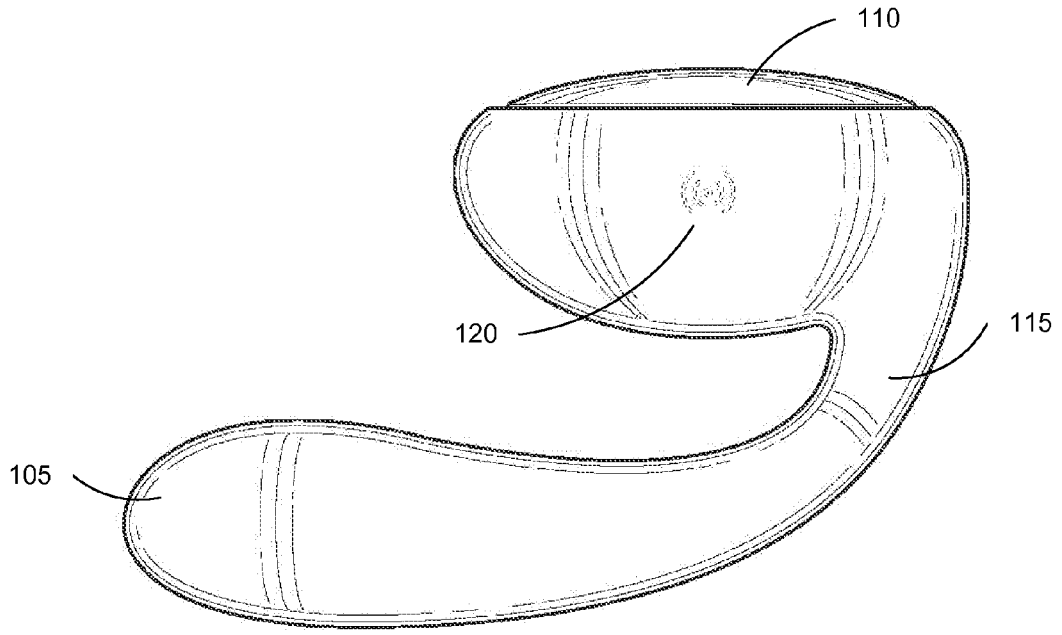
Figure 1D:
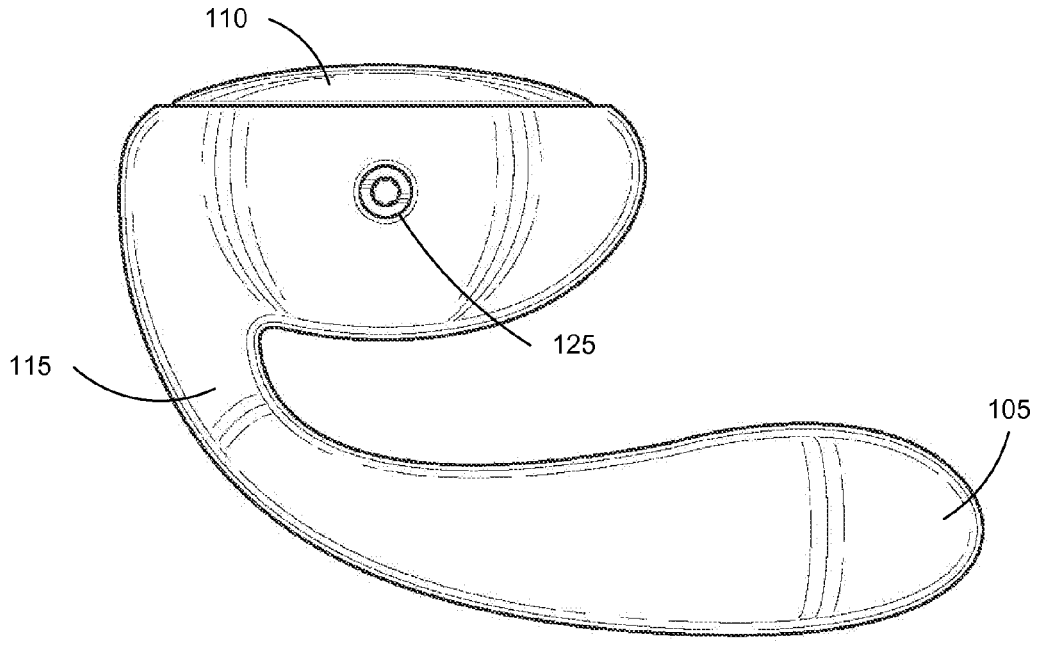

FIGS. 1A, 1B, 1C, and 1D collectively illustrate an example of a hands-free wearable massager 100 for couples, according to one embodiment. FIGS. 1A and 1B illustrate perspective views of the massager 100. FIGS. 1C and 1D illustrate side views of the massager 100. The massager 100 includes a first arm 105, a second arm 110, and a connecting member 115. In other embodiments, the massager 100 can include additional and/or different components to perform the functions as described. The exterior of the massager 100 can be made of a soft and elastic yet durable material, such as silicone, to enable the first arm 105 to rotate about the connecting member 115, massaging the inside surfaces of a user's vagina during use. The material used in the exterior of the massager can be selected from materials known to be non-reactive to human skin, beneficially decreasing the safety risks of using the massager. In addition, the massager 100 can be waterproof and may weigh less than 100 g. The functionalities of the massager 100 are further described below in conjunction with FIG. 2. The first arm 105 is coupled to the second arm 110 through the connecting member 115, which is coupled to the proximal ends of the first arm 105 and the second arm 110.

The massager 100 is structured such that the first arm 105 is inserted into a user's vagina and the second arm 110 is in contact with or near the user's clitoris during use. During use, the connecting arm 115 can be in contact with or near an area between the entry of the vagina and the region near the clitoris. The connecting member 115 and the first arm 110 are configured to allow for a user to simultaneously have intercourse (e.g., vaginal intercourse) with a partner while the massager 100 is being worn by the user. For example, the massager 100 can be worn with the first arm inserted into the vagina of a woman while the penis of a male partner is also inserted into the vagina. The massager 100 can also be worn during other forms of intercourse too.

The first arm 105 includes a distal end and a proximal end (which, as noted above, is coupled to the connecting member 115). In one embodiment, the width along the first arm 105 can vary and is larger near the center of the first arm 105 than at the distal end and the proximal end of the first arm 105. The first arm 105 can taper in width from a first width at or near the distal end of the first arm to a second, smaller width at the proximal end. For example, the width of the first arm 105 can range from 2-3 cm at or near the distal end and 1-2 cm near the proximal end. The length of the first arm 105 from the distal end to the proximal end can be 8-10 cm.

The first arm 105 is configured to rotate in an orbit around an axis substantially perpendicular to a cross-section of a proximal end of the first arm when the massager is in an operating mode. The distal end of the first arm 105 rotates in an orbit with a wider diameter than the center of the first arm 105 and the proximal end of the first arm 105. In one embodiment, the proximal end of the first arm 105 does not rotate but rather pivots at the intersection between the first arm 105 and the connecting member 115. The rotation of the first arm 105 when the massager is in an operating mode causes the first arm 105 to rotatably massage the interior of the user's vagina. In one embodiment, the first arm 105 is configured to vibrate in an operating mode, for instance when the first arm 105 is rotating or when the first arm 105 is not rotating. In various embodiments, the function (i.e., rotation, vibration, etc.) can be specified and selected by a user of the massager 100. For example, the user can select the function through a remote controller that is wirelessly paired to the massager 100. In one embodiment, the remote controller is the remote controller described in U.S. patent application Ser. No. 13/492,909, filed on Jun. 10, 2012, which is hereby incorporated by reference in its entirety.

The second arm 110 includes a distal end and a proximal end (which, as noted above, is coupled to the connecting member 115). In one embodiment, the second arm 110 includes an outer face and a base, and is shorter in length and greater in width than the first arm 105. In the embodiment shown in FIG. 1, the base is a partial oblate spheroid base. However, the base can be an oval shape or any other suitable shape that allows the massager 100 to function as a wearable clip when in use. In one example embodiment, the base can be approximately 3-6 cm in width. The second arm 110 can include a power source 210 for the massager, and can also provide a vibrating or massaging motion when used in an operating mode.

The connecting member 115 is configured to be adjustably fixed for use as a wearable clip by a user during use. For example, the connecting member 115 can be flexible enough such that a user can temporarily separate the first arm 105 and the second arm 110 to accommodate the insertion of the first arm of the massager into the user's vagina but rigid enough to allow the connecting member 115 to forcibly compress the first arm 105 toward the second arm 110, causing the massager to securely clip onto a user. For example, the connecting member 115 can act as a spring with a first spring constant that exceeds a threshold spring constant, limiting the flexibility of the connecting member 115. In other embodiments, the connecting member 115 includes a deformable material that can be reshaped or that is configurable into a plurality of curved shapes. Thus, a user can adjust the shape or curvature of the shape of the connecting member 115 during use, configuring the massager 100 to reduce or increase the distance between the first arm 105 and the second arm 110 to either tighten or loosen the massager 110. Accordingly, the adjustable connecting member 115 allows for insertion of the massager 100 while allowing a user to adjust the massager, when inserted, for comfort.

The massager 100 may also include additional features, such as a button 120 and a power connector interface 125. The button 120 can be an on/off switch for powering the massager 100 on and off. In addition, the button 120 can also activate wireless pairing of the massager 100 to a remote controller used to operate the massager 100. The button 120 may also be used to select a mode of massage or operation of the massager 100 during use. For example, the number of times a user pushes the button 120 can correlate to a mode of massage. The various modes of massage or operation can include different combinations, patterns, speeds, or intensities of vibrations, rotations, durations of vibrations, or any other suitable massaging motions. In some embodiments, the various modes of massage or operation can vary based on motion-sensing, as described in U.S. patent application Ser. No. 13/492,909, filed on Jun. 10, 2012, the contents of which are hereby incorporated in their entirety. In another embodiment, the remote controller comprises a motion sensor and the massager 100 operates responsive to the motion sensed by the remote controller. In one embodiment, the massager 100 comprises 6-10 modes of massage or operation, which, as used herein, a mode of operation can also be referred to as a "simulation mode".

The power connector interface 125 allows for recharging the power source of the massager 100 in a non-operating mode. For instance, the power connector interface 125 can allow for the insertion of a power cable to allow a user to electrically couple the massager 100 to a power outlet, allowing the massager 100 to draw power from the power outlet to recharge.

The massager 100 can also include an indicator to indicate power levels of the massager 100. For example, the indicator can indicate a power level of a power source within the massager 100, such as a battery or lithium-ion battery. The power level can be shown by lighting a number of light segments on the indicator reflective of the power level.

The indicator can also indicate a mode of massage or operation of the massager 100 during use, which can be selected by the user. The operating mode of massage can be shown through the indicator, for instance through various colors, indicator lights, symbols, and the like.

In one embodiment, the operating mode can also be selected by the user through an interface on the massager 100. The interface can include one or more additional buttons, in addition to the previously-described button 120, associated with the various operating modes, and is accessible to the user. For example, the interface comprising the one or more additional buttons can be integrated into the second arm 110, and can be accessible by the user during use of the massager 100.

Figure 2:
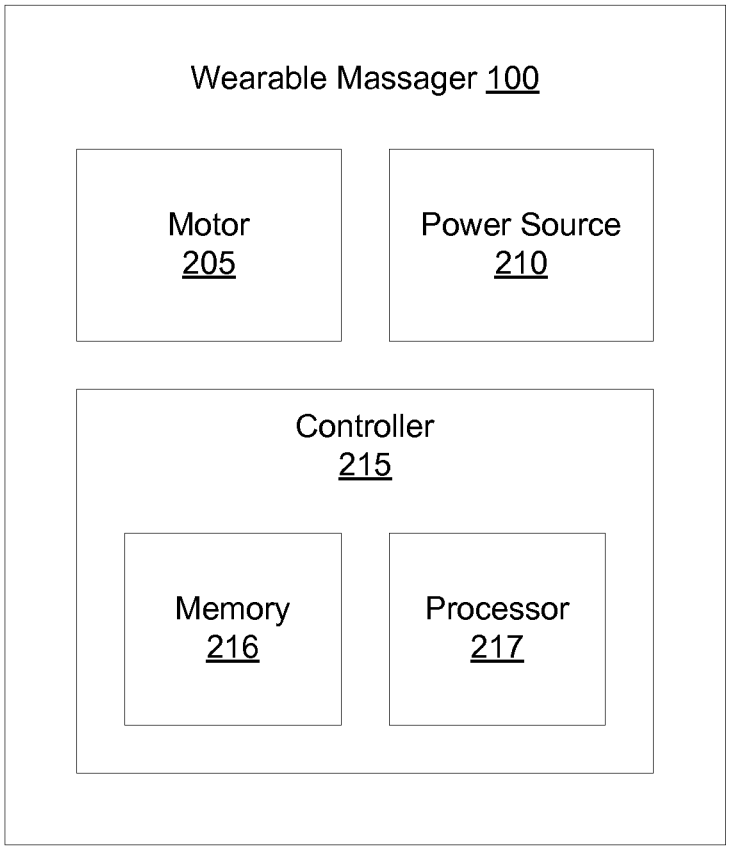
FIG. 2 is a block diagram of components of a wearable massager for couples, according to one embodiment.

FIG. 2 is a block diagram of components of a wearable massager for couples, according to one embodiment. This Figure provides an example of some of the components that might be included in the massager 100, though some designs may include different components. The massager 100 shown in FIG. 2 includes one or more motors 205, a power source 210, and a controller 215. The controller 215 controls the operating mode of the massager 100 using the one or more motors 205 and using power from the power source 210. In addition, the massager 100 can include sensors, such as a motion sensor.

The one or more motors 205 are integrated in the massager 100 and configured such that the motors rotate the first arm 105 about an axis, such as an axis that intersects a cross-section of the proximal end of the first arm 105 and/or the connecting member 115. In addition, the one or more motors 205 are also configured to provide vibrations within the first arm 105, the second arm 110, or both during the operating mode. The motors 205 can power rotation of off-center weights located within the first arm 105 and the second arm 110 can cause the rotation and vibration of the first arm 105 and the second arm 110. The one or more motors 205 can be electric or electromagnetic motors, such as an AC motor, a DC motor, or any other suitable motor or mechanism that converts electricity into a mechanical motion.

The power source 210 is electrically coupled to the one or more motors 205, and provides electrical power to the one or more motors 205. The power source 210 can include one or more batteries, lithium-ion batteries, capacitors, or any other suitable power source. The power source 210 is electrically coupled to the power connecting interface 125, and is configured to receive power from an external power source via the power connecting interface 125 to allow for charging the power source 210.

The controller 215 includes memory 216 and a processor 217, and is communicatively coupled to the one or more motors 205. The controller 215 stores one or more operating modes within the memory 216 as computer-executable instructions, each associated with a setting of one or more of vibrations, rotations, duration of vibrations, speed of vibrations and rotations, intensity of vibrations and rotations, diameter of rotations, and the like. The controller 215 implements one or more of the operating modes based on a selected operating mode, for instance by a user of the massager 100, through the massager 100 or remote controller. To implement an operating mode, the processor 217 accesses an operating mode stored in the memory 216, and executes the computer-executable instructions associated with the operating mode. In response, the executed instructions cause the motors 205 to implement vibrations and rotations associated with the operating mode. The massaging patterns of the massager's operating mode can vary in strength and duration, and, for vibration, can be the same or different for the first arm 105 and the second arm 110. In one example operating mode, the first arm 105 rotates at a fixed speed and diameter, and the second arm 110 pulsatingly vibrates.

In one embodiment, the massager 100 can include one or more motion sensors. Based on changes in the x-, y-, or z-axis, as detected by the one or more motion sensors, the mode of massage of the massager 100 can vary. In addition, the remote controller can include the one or more motion sensors and vary the mode of massage of the massager 100 based on detected changes in the x-, y-, or z-axis of the remote controller.

While various embodiments have been described above, it should be understood that they have been presented by way of example only, and not limitation. For example, any of the components may employ any of the desired functionality set forth hereinabove. The functions can be distributed differently across the components or different functions can be combined into one component. The massager can be designed to have a variety of different shapes and sizes, and the embodiments shown herein are simply examples of some such shapes and sizes. The internal components of the massager can vary, and can include fewer or more components that those shown here. Thus, the breadth and scope of a preferred embodiment should not be limited by any of the above-described exemplary embodiments.

What is claimed is:

1. A hands-free massager, comprising:

a first arm structured for insertion into a vagina, the first arm comprising one or more motors configured to cause a distal end of the first arm to rotate in an orbit around an axis substantially perpendicular to a cross-section of a proximal end of the first arm in an operating mode, the first arm tapering in width from a first width at the distal end of the first arm to a second width at the proximal end, the second width comprising a smaller width than the first width;

a second arm shorter in length than the first arm and comprising:

a partial oblate spheroid base comprising an oblate spheroid of which a portion has been flattened, an outer face on the partial oblate spheroid base, the outer face having an outer edge, a recess formed between the outer edge of the outer face and the flattened portion of the partial oblate spheroid base, one or more batteries within the second arm, and a power connector interface electronically coupled to the one or more batteries, the second arm configured to vibrate in the operating mode and structured for contact with a clitoris when the distal end of the first arm is inserted into a vagina; and a connecting member comprising a curved shape and coupled to the proximal end of the first arm and a proximal end of the second arm, the connecting member comprising a smaller width than the second width of the proximal end of the first arm and a width of the second arm.

2. The hands-free massager of claim 1, wherein the first arm is configured to vibrate in the operating mode.

3. The hands-free massager of claim 2, wherein the vibration of the first arm comprises one of a selectable plurality of vibration patterns.

4. The hands-free massager of claim 1, wherein the vibration of the second arm comprises one of a selectable plurality of vibration patterns.

5. The hands-free massager of claim 1, wherein the connecting member is configurable into a plurality of curved shapes.

6. The hands-free massager of claim 1, wherein the hands-free massager is configured to receive instructions for the operating mode from a remote controller communicatively coupled to the hands-free massager.

7. The hands-free massager of claim 1, wherein a width of the partial oblate spheroid base is between 4-6 cm.

8. The hands-free massager of claim 1, wherein an outer surface of the outer face and a surface of the flattened portion of the partial oblate spheroid base on which the outer face is mounted are substantially parallel.

9. The hands-free massager of claim 1, wherein the recess is along a circumference of the outer edge of the outer face.

10. The hands-free massager of claim 1, wherein the outer face is mounted and recessed into the flattened portion of the partial oblate spheroid base such that the flattened portion has an edge around the outer face, and wherein the recess is formed between the edge of the flattened portion and the outer edge of the outer face.

11. The hands-free massager of claim 1, wherein the outer face is circular in shape with a center portion raised relative to the outer edge.

12. A hands-free massager, comprising:

a first arm structured for insertion into a vagina, the first arm comprising one or more motors configured to cause a distal end of the first arm to rotate in an orbit around an axis substantially perpendicular to a cross-section of a proximal end of the first arm in an operating mode;

a second arm comprising:

a partial oblate spheroid base comprising an oblate spheroid of which a portion has been flattened, an outer face on the partial oblate spheroid base, the outer face having an outer edge, a recess formed between the outer edge of the outer face and the flattened portion of the partial oblate spheroid base, the second arm configured to vibrate in the operating mode and structured for contact with a clitoris when the distal end of the first arm is inserted into a vagina; and a connecting member coupled to the proximal end of the first arm and a proximal end of the second arm, wherein the connecting member comprises a smaller width than a width of the first arm and a width of the second arm.

13. The hands-free massager of claim 12, wherein the first arm is configured to vibrate in the operating mode, the vibration of the first arm comprising one of a selectable plurality of vibration patterns.

14. The hands-free massager of claim 12, wherein the first arm tapers in width from a first width at the distal end of the first arm to a second width at the proximal end, the second width comprising a smaller width than the first width.

15. The hands-free massager of claim 12, wherein the vibration of the second arm comprises one of a selectable plurality of vibration patterns.

16. The hands-free massager of claim 12, wherein the connecting member is configurable into a plurality of curved shapes.

17. A hands-free massager, comprising:

a first arm structured for insertion into a vagina, the first arm comprising one or more motors configured to cause a distal end of the first arm to rotate in an orbit around an axis substantially perpendicular to a cross-section of a proximal end of the first arm;

a second arm comprising:

an oblate spheroid base, and an outer face recessed into the oblate spheroid base and facing away from the first arm, the second arm configured to vibrate and structured for contact with a clitoris when the distal end of the first arm is inserted into a vagina; and a connecting member coupled to a proximal end of the first arm and a proximal end of the second arm, wherein the connecting member comprises a smaller circumference than a circumference of the first arm and a circumference of the second arm.

18. The hands-free massager of claim 17, wherein the outer face is recessed into the oblate spheroid such that a portion of the oblate spheroid is flattened.

* * * * *